US005883042A

United States Patent [19]

Defieuw et al.

[11] Patent Number: 5,883,042

[45] Date of Patent: Mar. 16, 1999

[54] (PHOTO)THERMOGRAPHIC MATERIAL WITH IMPROVED TRANSPORT PERFORMANCE

[75] Inventors: Geert Defieuw, Bonheiden; Wim Mües, Tremelo; Dirk Quintens, Lier; Ivan Hoogmartens, Wilrijk, all of Belgium

[73] Assignee: Agfa-Gevaert, Mortsel, Belgium

[21] Appl. No.: 862,813

[22] Filed: May 30, 1997

[30] Foreign Application Priority Data

Jun. 1, 1996 [EP] European Pat. Off. ..... 96201530

[51] Int. Cl.[6] ..... B41N 5/00

[52] U.S. Cl. ..... 503/201; 503/200; 503/202; 503/207; 503/210; 503/226

[58] Field of Search ..... 427/150–152; 503/202, 210, 200, 226, 201, 207

[56] References Cited

U.S. PATENT DOCUMENTS 5,468,603 11/1995 Kub ..... 430/619

OTHER PUBLICATIONS

Brochure describing 3M (now IMATION) DRYVIEW™ 8700 material on U.S. market since Oct. 1995.

*Primary Examiner*—Bruce H. Hess

*Attorney, Agent, or Firm*—Baker & Botts, L.L.P.

[57] ABSTRACT

A (photo)thermographic recording material comprising a (photo-addressable) thermosensitive element on one side of a water resistant support and an outermost backside layer on the other side of the water resistant support, the (photo-addressable) thermosensitive element comprising a substantially light-insensitive organic silver salt, an organic reducing agent for the substantially light-insensitive organic silver salt in thermal working relationship therewith(, photosensitive silver halide in catalytic association with the substantially light insensitive organic silver salt) and a binder and the outermost backside layer comprising polymeric beads, characterized in that an outermost layer on the side of the water resistant support with the (photo-addressable) thermosensitive element does not contain a fluorine-containing polymeric surfactant and the static frictional coefficient between the outermost layer on the side of the water resistant support with the (photo-addressable) thermosensitive element and the outermost backside layer is $\leqq 0.24$ and/or the outermost backside layer of the (photo)thermographic recording material has an $R_z$ determined according to DIN 4768/1 of >1.75 $\mu$m; and a (photo)thermographic recording process therefor.

8 Claims, No Drawings

(PHOTO)THERMOGRAPHIC MATERIAL WITH IMPROVED TRANSPORT PERFORMANCE

FIELD OF THE INVENTION

The present invention relates to a thermographic and photothermographic materials and recording processes therefor.

BACKGROUND OF THE INVENTION

Thermal imaging or thermography is a recording process wherein images are generated by the use of imagewise modulated thermal energy.

In thermography three approaches are known:

1. Imagewise transfer of an ingredient necessary for the chemical or physical process bringing about changes in colour or optical density to a receptor element containing other of the ingredients necessary for said chemical or physical process followed by uniform heating to bring about said changes in colour or optical density.
2. Thermal dye transfer printing wherein a visible image pattern is formed by transfer of a coloured species from an imagewise heated donor element onto a receptor element.
3. Direct thermal formation of a visible image pattern by imagewise heating of a recording material containing matter that by chemical or physical process changes colour or optical density.

According to U.S. Pat. No. 3,080,254 a typical heat-sensitive (thermographic) copy paper includes in the heat-sensitive layer a thermoplastic binder, e.g. ethyl cellulose, a water-insoluble silver salt, e.g. silver stearate and an appropriate organic reducing agent, of which 4-methoxy-1-hydroxy-dihydronaphthalene is a representative. Localized heating of the sheet in the thermographic reproduction process, or for test purposes by momentary contact with a metal test bar heated to a suitable conversion temperature in the range of about 90°–150° C., causes a visible change to occur in the heat-sensitive layer. The initially white or lightly coloured layer is darkened to a brownish appearance at the heated area. In order to obtain a more neutral colour tone a heterocyclic organic toning agent such as phthalazinone is added to the composition of the heat-sensitive layer. Thermo-sensitive copying paper is used in "front-printing" or "back-printing" using infra-red radiation absorbed and transformed into heat in contacting infra-red light absorbing image areas of an original as illustrated in FIGS. 1 and 2 of U.S. Pat. No. 3,074,809.

Thermographic materials of type 3 can be rendered photothermographic by incorporating a photosensitive agent which after exposure to UV, visible or IR light is capable of catalyzing or participating in a thermographic process bringing about changes in colour or optical density.

Examples of photothermographic materials are the so called "Dry Silver" photographic materials of the 3M Company, which are reviewed by D. A. Morgan in "Handbook of Imaging Science", edited by A. R. Diamond, page 43, published by Marcel Dekker in 1991.

U.S. Pat. No. 3,152,904 discloses an image reproduction sheet which comprises a radiation-sensitive heavy metal salt which can be reduced to free metal by a radiation wave length between an X-ray wave length and a five microns wave length and being distributed substantially uniformly laterally over said sheet, and as the image forming component an oxidation-reduction reaction combination which is substantially latent under ambient conditions and which can be initiated into reaction by said free metal to produce a visible change in colour comprising an organic silver salt containing carbon atoms and different from said heavy metal salt as an oxidizing agent and in addition an organic reducing agent containing carbon atoms, said radiation-sensitive heavy metal salt being present in an amount between about 50 and about 1000 parts per million of said oxidation-reduction reaction combination.

WO 94/11198 discloses a recording material comprising on a support (i) a heat sensitive layer comprising a substantially light insensitive organic silver salt, (ii) a protective layer containing a matting agent dispersed in a binder and (iii) a reducing agent being present in the heat sensitive layer and/or another layer on the same side of the support carrying the heat sensitive layer. However, the presence of the large quantities of matting agent required to obtain optimum slip properties will in the case of inorganic matting agents lead to premature failure of the thermal head due to abrasion and in the case of organic matting agents lead to image faults due to accumulation of particles on the thermal head. Furthermore, protective layer thicknesses of at least 2 μm are necessary to avoid deformation of the material during printing and particles of matting agent sink into the protective layer during the thermal development process thereby reducing their slip properties. This can be avoided by using larger matting agent particles, but with adverse effects on the thermal contact of the thermal head with the material and on the image quality obtained.

U.S. Pat No. 5,468,603 discloses a thermographic element comprising a support having coated thereon: (a) a thermographic emulsion layer comprising a non-photosensitive reducible source of silver, a reducing agent for silver ion, and a binder; (b) a layer adjacent to said thermographic emulsion layer comprising a binder and a polymeric fluorinated surfactant; and (c) an outermost layer which is not removed during development of said thermographic element and which is positioned on the side of said support opposite from said thermographic emulsion layer, said outermost layer consisting essentially of a plurality of optically transparent organic polymeric beads. According to the detailed description of U.S. Pat. No. 5,468,603, "The smoothness of the bead surface and shape of the bead are chosen such that the amount of reflected visible wavelengths (400 nm to 700 nm) of light is kept to a minimum. The shape of the beads is preferably spherical, oblong, ovoid, or elliptical. The particle diameter is preferably in a size range of 1–12 μm in average size, more preferably, 1.5 to 10 μm in average size; and most preferably 2–9 μm in average size, particularly with fewer than 25% of the total number of beads being outside a range of ±15% of the average size of the beads. The beads may be present on the surface from about 50 to 500 beads per square millimeter; more preferably 75 to 400 beads per square millimeter; and most preferably 100 to 300 beads per square millimeter. The increase in percent haze due to the introduction of the beads into the construction is preferably no more than 15%; more preferably no more than 8%; and most preferably no more than 6%. The optically transparent organic polymeric beads which alter the separation or slip characteristics of the element's surface are provided in the imaging layers in such a manner that they tend to protrude from the surface of the outermost layer. The thickness of the outermost backside layers are typically 0.5 to 6 μm." In the invention examples of U.S. Pat No. 5,468,603, backside compositions are disclosed consisting of 0.5 to 5.8% of polymeric beads, the beads consisting of 7 μm polystyrene methacrylate and 13 μm polymethyl methacrylate beads, 83.5 to 92.7% of cellulose acetate butyrate, 1.2 to 1.3% of a polyester resin, 0.9 to 1.0% of an antihalation dye and 0.08 to 13.4% of antistat L. However, thermal development of thermographic materials with a thermal head is usually carried out with the thermal head in contact with the coating on the thermographic emulsion side of the support. The fluorine-containing surfactant in the outermost layer on the thermographic emulsion side of the support in contact with the thermal head can, at the high temperatures necessary for thermal development, decompose to a small extent resulting in the production of small quantities of hydrogen fluoride, which will attack the outermost layer of the thermal head causing premature failure of the thermal head. Furthermore in the case of photothermographic materials rapid pulsed heating with a thermal head can be used together with image density detection to increase the image density to a predetermined standard level. The presence of a fluorine-containing surfactant in the protective layer of photothermographic recording materials can, therefore, also lead to premature failure of thermal heating components.

OBJECTS OF THE INVENTION

It is therefore an object of the present invention to provide a thermographic recording material exhibiting reliable separation and transport in a thermographic printer.

It is therefore another object of the present invention to provide a thermographic recording material exhibiting reproducibly high image quality in a thermographic printer.

It is therefore a further object of the present invention to provide a thermographic recording material not contributing to premature failure of thermal heads.

It is therefore an object of the present invention to provide a photothermographic recording material exhibiting reliable separation and transport in a photothermographic printer.

It is therefore another object of the present invention to provide a photothermographic recording material exhibiting reproducibly high image quality in a photothermographic printer.

It is therefore a further object of the present invention to provide a photothermographic recording material not contributing to premature failure of thermal heads.

Other objects and advantages of the present invention will become clear from the further description and examples

SUMMARY OF THE INVENTION

According to the present invention a thermographic recording material is provided comprising a thermosensitive element on one side of a water resistant support and an outermost backside layer on the other side of the water resistant support, the thermosensitive element comprising a substantially light-insensitive organic silver salt, an organic reducing agent for the substantially light-insensitive organic silver salt in thermal working relationship therewith and a binder and the outermost backside layer comprising polymeric beads, characterized in that an outermost layer on the side of the water resistant support with the thermosensitive element does not contain a fluorine-containing polymeric surfactant and the static frictional coefficient between the outermost layer on the side of the water resistant support with the thermosensitive element and the outermost backside layer is $\leqq 0.24$ and/or the outermost backside layer of the thermographic recording material has an $R_z$ determined according to DIN 4768/1 of $>1.75$ $\mu$m.

According to the present invention a thermographic recording process is also provided comprising the steps of: (i) providing a thermographic material as referred to above; (ii) bringing the side of the water resistant support with the thermosensitive element into contact with a thermal head; (iii) image-wise heating the thermographic material by pixel-wise heating with the thermal head; and (iv) removing the thermographic recording material from the thermal head.

Furthermore a photothermographic recording material is provided, according to the present invention, comprising a photo-addressable thermosensitive element on one side of a water resistant support and an outermost backside layer on the other side of the water resistant support, the photo-addressable thermosensitive element comprising a substantially light-insensitive organic silver salt, an organic reducing agent for the substantially light-insensitive organic silver salt in thermal working relationship therewith, photosensitive silver halide in catalytic association with the substantially light insensitive organic silver salt and a binder and the outermost backside layer comprising polymeric beads, characterized in that an outermost layer on the side of the water resistant support with the photo-addressable thermosensitive element does not contain a fluorine-containing polymeric surfactant and the static frictional coefficient between the outermost layer on the side of the water resistant support with the photo-addressable thermosensitive element and the outermost backside layer is $\leqq 0.24$ and/or the outermost backside layer of the photothermographic recording material has an $R_z$ determined according to DIN 4768/1 of $>1.75$ $\mu$m.

A photothermographic recording process is also provided, according to the present invention, comprising the steps of: (i) providing a photothermographic recording material as referred to above; (ii) image-wise exposing the photo-addressable thermosensitive element with actinic radiation; (iii) bringing the image-wise exposed photothermographic recording material into proximity with a heat source; (iv) uniformly heating the image-wise exposed photothermographic recording material; and (v) removing the photothermographic recording material from said the source.

DETAILED DESCRIPTION OF THE INVENTION

Outermost Backside Layer

The outermost backside layer according to the present invention comprises polymeric beads. Suitable beads may be produced by free radical polymerization, ionic polymerization or condensation poymerization of polymerizable monomer or monomer mixtures by, for example, suspension or emulsion polymerization and are preferably at least partially crosslinked to endow the beads with some form-stability under the high local temperatures attained during thermal development of the thermographic and photothermographic recording materials of the present invention. Suitable monomers are, for example, methacrylates, acrylates, styrene, butadiene, isoprene, divinylbenzene, methacrylic acid, acrylic acid, vinyl acetate, itaconic acid, halo-containing vinyl monomers and the like. Suitable polymeric beads can be produced as described in U.S. Pat No. 4,861,818 and EP-B 80 225.

Preferred polymeric beads have a weight averaged diameter between 1 and 20 $\mu$m with diameters between 2 and 12 $\mu$m being particularly preferred.

The outermost backside layer, according to the present invention, may further comprise a binder to promote adhesion of the polymeric beads to the support, although subbing of the support with an adhesion promoting layer may of itself be sufficient to provide the necessary adhesion.

Suitable binders for use in the outermost backside layer may be hydrophilic or hydrophobic depending upon the choice of polymeric beads and can be present in the coating solution in dissolved form or dispersed form such as, for example, polymer latexes or polymer dispersions. Coating may be performed from aqueous or solvent media. Polymeric latexes are preferred, since these allow a hydrophobic outermost backside layer to be coated from an aqueous medium. Particularly preferred are latexes based on acrylates or methacrylates, with polymethyl methacrylate latexes being especially preferred. Suitable latexes have average particle sizes between 20 and 500 nm, with average particle sizes between 30 and 200 nm being particularly preferred. A cosolvent may be used during the coating process to improve the film-forming properties of the latexes e.g. N-methylpyrrolidone.

The outermost backside layer, according to the present invention, may further comprise colloidal silica, which may be hydrophilic or hydrophobic. Hydrophilic colloidal silica is preferred with average particles sizes between 3 and 50 nm. Colloidal silica can be used in an acidic or basic form with the basic form being preferred.

The outermost backside layer, according to the present invention, may further comprise an antihalation dye, such as those disclosed in the section on antihalation dyes, to increase image sharpness upon image-wise heating of a thermographic recording material using an infra-red heat source, for example with a Nd-YAG laser or other infra-red laser, or image-wise exposure of a photothermographic recording material.

The outermost backside layer, according to the present invention, may also further comprise an antistatic species to prevent the buildup of charge due to triboelectric contact during coating, transport during finishing and packaging and in an apparatus for image-wise heating or for image-wise exposure followed by thermal development. For example polymeric beads may be incorporated into antistatic layers.

Suitable antistatic layers are described in EP-A's 444 326, 534 006 and 644 456, U.S. Pat. Nos. 5,364,752 and 5,472,832 and DOS 4125758. Particularly preferred antistatic layers are those based on polythiophene as disclosed in EP-A 628 560, U.S. Pat. No. 5,354,613, U.S. Pat. No. 5,372,924, U.S. Pat. No. 5,370,981 and U.S. Pat. No. 5,391,472.

In a preferred embodiment of the thermographic recording material, according to the present invention, the outermost layer on the side of the water resistant support with the thermosensitive element has an $R_z$ determined according to DIN 4768/1 of <1.75 $\mu$m.

In a preferred embodiment of the photothermographic recording material, according to the present invention, the outermost layer on the side of the water resistant support with the photo-addressable thermosensitive element has an $R_z$ determined according to DIN 4768/1 of <1.75 $\mu$m.

According to DIN 4768/1, $R_z$ is defined as the average of the single peak-to-valley heights of five adjoining sampling lengths $1_e$ The thickness of the outermost backside layer is preferably between 0.1 and 5 $\mu$m and particularly preferably between 0.3 and 1 $\mu$m, the outermost backside layer being preferably thinner than that of the outermost layer on the same side of the support as the thermosensitive or photo-addressable thermosensitive element.

Antistatic Layer

If the outermost backside layer is not an antistatic layer, an antistatic layer may be provided between the support and the outermost backside layer. Non-outermost antistatic layers are, for example, disclosed in U.S. Pat. No. 5,310,640, U.S. Pat. No. 5,312,681 and U.S. Pat. No. 5,372,924.

Thermosensitive Element

The thermosensitive element, according to the present invention comprises a substantially light-insensitive organic silver salt and an organic reducing agent therefor in thermal working relationship therewith and a binder. The element may comprise a layer system in which the ingredients may be dispersed in different layers, with the proviso that the substantially light-insensitive organic silver salt and the organic reducing agent are in thermal working relationship with one another i.e. during the thermal development process the reducing agent must be present in such a way that it is able to diffuse to said substantially light-insensitive organic silver salt particles so that reduction of the organic silver salt can take place.

The thermosensitive element can be rendered photo-addressable by the presence of photosensitive silver halide in catalytic association with the substantially light-insensitive organic silver salt or of a component which is capable of forming photosensitive silver halide with the substantially light-insensitive organic silver salt.

Substantially light-insensitive organic silver salts

Preferred substantially light-insensitive organic silver salts according to the present invention are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps"; silver dodecyl sulphonate described in U.S. Pat. No. 4,504,575; and silver di-(2-ethylhexyl)-sulfosuccinate described in EP-A 227 141. Modified aliphatic carboxylic acids with thioether group as described e.g. in GB-P 1,111,492 and other organic silver salts as described in GB-P 1,439,478, e.g. silver benzoate and silver phthalazinone, may be used likewise to produce a thermosensitive silver image. Further are mentioned silver imidazolates and the substantially light-insensitive inorganic or organic silver salt complexes described in U.S. Pat. No. 4,260,677.

A suspension of particles containing a substantially light-insensitive organic silver salt may be obtained by using a process, comprising simultaneous metered addition of a solution or suspension of an organic compound with at least one ionizable hydrogen atom or its salt; and a solution of a silver salt to a liquid, as described in the unpublished European patent application number 95201968.5.

Organic Reducing Agent

Suitable organic reducing agents for the reduction of said substantially light-insensitive organic heavy metal salts are organic compounds containing at least one active hydrogen atom linked to O, N or C, such as is the case with, mono-, bis-, tris- or tetrakis-phenols; mono- or bis-naphthols; di- or polyhydroxy-naphthalenes; di- or polyhydroxybenzenes; hydroxymonoethers such as alkoxynaphthols, e.g. 4-methoxy-1-naphthol described in U.S. Pat. No. 3,094,41; pyrazolidin-3-one type reducing agents, e.g. PHENIDONE™; pyrazolin-5-ones; indan-1,3-dione derivatives; hydroxytetrone acids; hydroxytetronimides; 3-pyrazolines; pyrazolones; reducing saccharides; aminophenols e.g. METOL™; p-phenylenediamines, hydroxylamine derivatives such as for example described in U.S. Pat. No. 4,082,901; reductones e.g. ascorbic acids; hydroxamic acids;

hydrazine derivatives; amidoximes; n-hydroxyureas; and the like, see also U.S. Pat. Nos. 3,074,809, 3,080,254, 3,094,417 and 3,887,378.

Among useful aromatic di- and tri-hydroxy compounds having at least two hydroxy groups in ortho- or para-position on the same aromatic nucleus, e.g. benzene nucleus, hydroquinone and substituted hydroquinones, catechol, 3-(3',4'-dihydroxyphenyl)propionic acid, pyrogallol, gallic acid and gallic acid esters are preferred. Particularly useful are polyhydroxy spiro-bis-indane compounds, especially these corresponding to the following general formula (I):

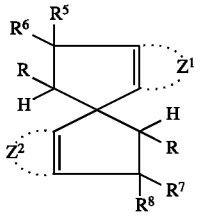

(I)

wherein:

R represents hydrogen or alkyl, e.g. methyl or ethyl, each of $R^5$ and $R^6$ (same or different) represents, an alkyl group, preferably methyl group or a cycloalkyl group, e.g. cyclohexyl group, each of $R^7$ and $R_8$ (same or different) represents, an alkyl group, preferably methyl group or a cycloalkyl group, e.g. cyclohexyl group, and each of $Z^1$ and $Z^2$ (same or different) represents the atoms necessary to close an aromatic ring or ring system, e.g. benzene ring, substituted with at least two hydroxyl groups in ortho- or para-position and optionally further substituted with at least one hydrocarbon group, e.g an alkyl or aryl group.

In particular are mentioned the polyhydroxy-spiro-bis-indane compounds described in U.S. Pat. No. 3,440,049 as photographic tanning agent, more especially 3,3,3',3'-tetramethyl-5,6,5',6'-tetrahydroxy-1,1'-spiro-bis-indane (called indane I) and 3,3,3',3'-tetramethyl-4,6,7,4',6',7'-hexahydroxy-1,1'-spiro-bis-indane (called indane II). Indane is also known under the name hydrindene.

Among the catechol-type reducing agents, by which is meant reducing agents containing at least one benzene nucleus with two hydroxy groups (—OH) in ortho-position, are preferred, e.g. catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid esters. Particularly preferred catechol-type reducing agents, described in EP-A 692 733, are benzene compounds in which the benzene nucleus is substituted by no more than two hydroxy groups which are present in 3.4-position on said nucleus and have in the 1-position of said nucleus a substituent linked to said nucleus by means of a carbonyl group.

Polyphenols such as the bisphenols used in the 3M Dry Silver™ materials, sulfonamide phenols such as used in the Kodak Dacomatic™ materials, and naphthols are particularly preferred for photothermographic recording materials with photo-addressable thermosensitive elements on the basis of photosensitive silver halide/organic silver salt/reducing agent.

Reducing Agent Incorporation

During the thermal development process the reducing agent must be present in such a way that it is able to diffuse to said substantially light-insensitive organic heavy metal salt particles so that reduction of said organic heavy metal salt can take place.

Molar Ratio of Reducing Agent : Organic Silver Salt

The silver image density depends on the coverage of the above defined reducing agent(s) and organic silver salt(s) and has to be preferably such that, on heating above 80° C., an optical density of at least 1.5 can be obtained. Preferably at least 0.10 moles of reducing agent per mole of organic heavy metal salt is used.

Auxiliary Reducing Agents

The above mentioned reducing agents being considered as primary or main reducing agents may be used in conjunction with so-called auxiliary reducing agents. Such auxiliary reducing agents are e.g. sterically hindered phenols, that on heating become reactive partners in the reduction of the substantially light-insensitive organic heavy metal salt such as silver behenate, such as described in U.S. Pat. No. 4,001,026; or are bisphenols, e.g. of the type described in U.S. Pat. No. 3,547,648. The auxiliary reducing agents may be present in the imaging layer or in a polymeric binder layer in thermal working relationship thereto.

Preferred auxiliary reducing agents are sulfonamidophenols corresponding to the following general formula:

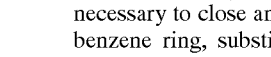

in which

Aryl represents a monovalent aromatic group, and

Arylene represents a bivalent aromatic group, having the —OH group preferably in para-position to the —$SO_2$—NH— group.

Sulfonamidophenols according to the above defined general formula are described in the periodical Research Disclosure, Febuary 1979, item 17842, in U.S. Pat. Nos. 4,360,581 and 4,782,004, and in published European Patent Application No. 423 891, wherein these reducing agents are mentioned for use in a photothermographic recording material in which photosensitive silver halide is present in catalytic proximity to a substantially light-insensitive silver salt of an organic acid.

Other auxiliary reducing agents that may be used in conjunction with the above mentioned primary reducing agents are sulfonyl hydrazide reducing agents such as disclosed in U.S. Pat. No. 5,464,738, trityl hydrazides and formyl-phenyl-hydrazides such as disclosed in U.S. Pat. No. 5,496,695 and organic reducing metal salts, e.g. stannous stearate described in U.S. Pat. Nos. 3,460,946 and 3,547,648.

Film-Forming Binders for Thermosensitive Element

The film-forming binder for the photo-addressable thermosensitive element according to the present invention may be coatable from a solvent or aqueous dispersion medium.

The film-forming binder for the photo-addressable thermosensitive element according to the present invention may be coatable from a solvent dispersion medium, according to the present invention, may be all kinds of natural, modified natural or synthetic resins or mixtures of such resins, wherein the organic silver salt can be dispersed homogeneously: e.g. polymers derived from (αβ,-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof. A particularly suitable polyvinyl butyrals containing a minor amount of vinyl alcohol units are marketed under the trade name BUTVAR™ B76 and BUTVAR™ B79 of Monsanto USA and provides a good adhesion to paper and properly subbed polyester supports The film-forming binder for the photo-addressable thermosensitive element coatable from an aqueous dispersion medium, according to the present invention, may be all kinds of transparent or translucent water-dispersible or water soluble natural, modified natural or synthetic resins or mixtures of such resins, wherein the organic silver salt can be dispersed homogeneously for example proteins, such as gelatin and gelatin derivatives (e.g. phthaloyl gelatin), cellulose derivatives, such as carboxymethylcellulose, polysaccharides, such as dextran, starch ethers etc., galactomannan, polyvinyl alcohol, polyvinylpyrrolidone, acrylamide polymers, homo- or co-polymerized acrylic or methacrylic acid, latexes of water dispersible polymers, with or without hydrophilic groups, or mixtures thereof. Polymers with hydrophilic functionality for forming an aqueous polymer dispersion (latex) are described e.g. in U.S. Pat. No. 5,006,451, but serve therein for forming a barrier layer preventing unwanted diffusion of vanadium pentoxide present as an antistatic agent.

Weight Ratio of Binder to Organic Silver salt

The binder to organic heavy metal salt weight ratio is preferably in the range of 0.2 to 6, and the thickness of the recording layer is preferably in the range of 5 to 50 μm.

Thermal Solvents

The above mentioned binders or mixtures thereof may be used in conjunction with waxes or "heat solvents" also called "thermal solvents" or "thermosolvents" improving the reaction speed of the redox-reaction at elevated temperature.

By the term "heat solvent" in this invention is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the organic heavy metal salt, at a temperature above 60° C. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydro-thiophene-1,1-dioxide, methyl anisate and 1,10-decanediol being described as heat solvents in Research Disclosure, December 1976, (item 15027) pages 26–28. Still other examples of heat solvents have been described in U.S. Pat. Nos. 3,438,776, and 4,740,446, and in published EP-A 0 119 615 and 0 122 512 and DE-A 3 339 810.

Polycarboxylic Acids and Anhydrides thereof

According to the recording material of the present invention the thermosensitive element may comprise in addition at least one polycarboxylic acid and/or anhydride thereof in a molar percentage of at least 20 with respect to all said organic silver salt(s) present and in thermal working relationship therewith. The polycarboxylic acid may be aliphatic (saturated as well as unsaturated aliphatic and also cycloaliphatic) or an aromatic polycarboxylic acid. These acids may be substituted e.g. with alkyl, hydroxyl, nitro or halogen. They may be used in anhydride form or partially esterified on the condition that at least two free carboxylic acids remain or are available in the heat recording step.

Particularly suitable are saturated aliphatic dicarboxylic acids containing at least 4 carbon atoms, e.g. : succinic acid, glutaric acid, adipic acid, pimelic acid, suberic acid, azelaic acid, sebacic acid, nonane-dicarboxylic acid, decane-dicarboxylic acid, undecane-dicarboxylic acid.

Suitable unsaturated dicarboxylic acids are : maleic acid, citraconic acid, itaconic acid and aconitic acid. Suitable polycarboxylic acids are citric acid and derivatives thereof, acetonedicarboxylic acid, iso-citric acid and α-ketoglutaric acid.

Preferred aromatic polycarboxylic acids are ortho-phthalic acid and 3-nitro-phthalic acid, tetrachlorophthalic acid, mellitic acid, pyromellitic acid and trimellitic acid and the anhydrides thereof.

Toning Agent

In order to obtain a neutral black image tone in the higher densities and neutral grey in the lower densities the recording layer contains preferably in admixture with said organic heavy metal salts and reducing agents a so-called toning agent known from thermography or photothermography.

Suitable toning agents are succinimide, phthalazine and the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toner compounds of the benzoxazine dione or naphthoxazine dione type within the scope of following general formula:

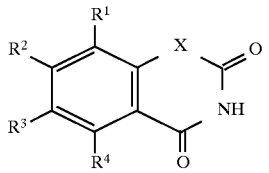

in which:

X represents O or N-alkyl;

each of $R^1$, $R^2$, $R^3$ and $R^4$ (same or different) represents hydrogen, alkyl, e.g. C1–C20 alkyl, preferably C1–C4 alkyl, cycloalkyl, e.g. cyclopentyl or cyclohexyl, alkoxy, preferably methoxy or ethoxy, alkylthio with preferably up to 2 carbon atoms, hydroxy, dialkylamino of which the alkyl groups have preferably up to 2 carbon atoms or halogen, preferably chlorine or bromine; or $R^1$ and $R^2$ or $R^2$ and $R^3$ represent the ring members required to complete a fused aromatic ring, preferably a benzene ring, or $R^3$ and $R^4$ represent the ring members required to complete a fused aromatic aromatic or cyclohexane ring. Toners within the scope of said general formula are described in GB-P 1,439,478 and U.S. Pat. No. 3,951,660.

A toner compound particularly suited for use in combination with polyhydroxy benzene reducing agents is 3,4-dihydro-2,4-dioxo-1,3,2H-benzoxazine described in U.S. Pat No. 3,951,660.

Photosensitive Silver Halide

The photosensitive silver halide used in the present invention may be employed in a range of 0.75 to 25 mol percent and, preferably, from 2 to 20 mol percent of substantially light-insensitive organic silver salt.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., a reducing agent such as a tin halide etc., or a combination thereof. The details of these procedures are described in T. H. James, "The Theory of the Photographic Process", Fourth Edition, Macmillan Publishing Co. Inc., New York (1977), Chapter 5, pages 149 to 169.

Emulsion of Organic Silver Salt and Photosensitive Silver Halide

A suspension of particles containing a substantially light-insensitive silver salt of an organic carboxylic acid may be obtained by using a process, comprising simultaneous metered addition of an aqueous solution or suspension of an organic carboxylic acid or its salt; and an aqueous solution of a silver salt to an aqueous liquid, as described in the unpublished European patent application number 95201968.5.

The silver halide may be added to the photo-addressable thermosensitive element in any fashion which places it in catalytic proximity to the substantially light-insensitive organic silver salt. Silver halide and the substantially light-insensitive organic silver salt which are separately formed, i.e. ex-situ or "preformed", in a binder can be mixed prior to use to prepare a coating solution, but it is also effective to blend both of them for a long period of time. Furthermore, it is effective to use a process which comprises adding a halogen-containing compound to the organic silver salt to partially convert the substantially light-insensitive organic silver salt to silver halide as disclosed in U.S. Pat. No. 3,457,075.

A particularly preferred mode of preparing the emulsion of organic silver salt and photosensitive silver halide for coating of the photo-addressable thermosensitive element from solvent media, according to the present invention is that disclosed in U.S. Pat. No. 3,839,049, but other methods such as those described in Research Disclosure, June 1978, item 17029 and U.S. Pat. No. 3,700,458 may also be used for producing the emulsion.

Spectral Sensitizer

The photo-addressable thermosensitive element of the photothermographic recording material, according to the present invention, may contain a spectral sensitizer, optionally together with a supersensitizer, for the silver halide. The silver halide may be spectrally sensitized with various known dyes including cyanine, merocyanine, styryl, hemicyanine, oxonol, hemioxonol and xanthene dyes optionally, particularly in the case of sensitization to infra-red radiation, in the presence of a so-called supersensitizer. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective. Suitable sensitizers of silver halide to infra-red radiation include those disclosed in the EP-A's 465 078, 559 101, 616 014 and 635 756, the JN's 03-080251, 03-163440, 05-019432, 05-072662 and 06-003763 and the U.S. Pat. Nos. 4,515,888, 4,639,414, 4,713,316, 5,258,282 and 5,441,866. Suitable supersensitizers for use with infra-red spectral sensitizers are disclosed in EP-A's 559 228 and 587 338 and in the U.S. Pat. Nos. 3,877,943 and 4,873,184.

Anti-Halation Dyes

In addition to said ingredients, the photothermographic recording material of the present invention may contain anti-halation or acutance dyes which absorb light which has passed through the photosensitive layer, thereby preventing its reflection. Such dyes may be incorporated into the photo-addressable thermosensitive element or in any other layer comprising the photothermographic recording material of the present invention. The anti-halation dye may also be bleached either thermally during the thermal development process, as disclosed in the U.S. Pat. Nos. 4,033,948, 4,088,497, 4,153,463, 4,196,002, 4,201,590, 4,271,263, 4,283,487, 4,308,379, 4,316,984, 4,336,323, 4,373,020, 4.548,896, 4,594,312, 4,977,070, 5,258,274, 5,314,795 and 5,312,721, or photo-bleached after the thermal development process, as disclosed in the U.S. Pat. Nos. 3,984,248, 3,988,154, 3,988,156, 4,111,699 and 4,359,524. Furthermore the anti-halation layer may be contained in a layer which can be removed subsequent to the exposure process, as disclosed in U.S. Pat. No. 4,477,562 and EP-A 491 457. Suitable anti-halation dyes for use with infra-red light are described in the EP-A's 377 961 and 652 473, the EP-B's 101 646 and 102 781 and the U.S. Pat. Nos. 4,581,325 and 5,380,635.

Other Additives

In addition to said ingredients the (photo-addressable) thermosensitive element may contain other additives such as free fatty acids, surface-active agents, e.g. non-ionic anti-static agents including a fluorocarbon group as e.g. in $F_3C(CF_2)_6CONH(CH_2CH_2O)$—H, silicone oil, e.g. BAYSILONE™ ÖA (from BAYER AG, GERMANY), ultraviolet light absorbing compounds, white light reflecting and/or ultraviolet radiation reflecting pigments, silica, colloidal silica, fine polymeric particles [e.g. of poly (methylmethacrylate)] and/or optical brightening agents.

Support

The support for the (photo)thermographic recording material according to the present invention may be transparent, translucent or opaque, e.g. having a white light reflecting aspect and is preferably a thin flexible carrier made e.g. from paper, polyethylene coated paper or transparent resin film, e.g. made of a cellulose ester, e.g. cellulose triacetate, corona and flame treated polypropylene, polystyrene, polymethacrylic acid ester, polycarbonate or polyester, e.g. polyethylene terephthalate or polyethylene naphthalate as disclosed in GB 1,293,676, GB 1,441,304 and GB 1,454,956. For example, a paper base substrate is present which may contain white reflecting pigments, optionally also applied in an interlayer between the recording material and the paper base substrate.

The support may be in sheet, ribbon or web form and subbed or pretreated, if need be to improve the adherence to the thereon coated thermosensitive element and antistatic outermost backing layer.

Suitable subbing layers for improving the adherence of the thermosensitive element and the antistatic layer outermost backing layer of the present invention for polyethylene terephthalate supports are described e.g. in GB-P 1,234,755, U.S. Pat. Nos. 3,397,988; 3,649,336; 4,123,278 and U.S. Pat. No. 4,478,907 which relates to subbing layers applied from aqueous dispersion of sulfonated copolyesters, and further the subbing layers described in Research Disclosure published in Product Licensing Index, July 1967, p. 6.

Suitable pretreatments of hydrophobic resin supports are, for example, treatment with a corona discharge and/or attack by solvent(s), thereby providing a micro-roughening.

The support may be made of an opacified resin composition, e.g. polyethylene terephthalate opacified by means of pigments and/or micro-voids and/or coated with an opaque pigment-binder layer, and may be called synthetic paper, or paperlike film; information about such supports can be found in EP's 194 106 and 234 563 and U.S. Pat. Nos. 3,944,699, 4,187,113, 4,780,402 and 5,059,579. Should a transparent base be used, the base may be colourless or coloured, e.g. having a blue colour.

Outermost Layer on same side of Support as Thermosensitive Element

The outermost layer of the (photo) thermographic recording material may in different embodiments of the present invention be the outermost layer of the (photo-addressable) thermosensitive element or a protective layer applied to the (photo-addressable) thermosensitive element.

Lubricants for Outermost Layer on same Side of Support as Thermosensitive Element The (photo-addressable) thermosensitive element may be provided with an outermost layer comprising at least one lubricant to improve the slipping properties of the (photo) thermographic recording material. Preferably at least one solid lubricant having a melting point below 150° C. and at least one liquid lubricant in a binder is used, wherein at least one of the lubricants is a phosphoric acid derivative.

Suitable solid lubricants, according to the present invention, have a melting point below 150° C. Preferred are solid lubricants having a melting point below 110° C., with solid lubricants with a molecular weight below 1000 being particularly preferred. For the purposes of the present invention solid lubricants are defined as those lubricants being solid at room temperature.

Solid lubricants which can be used according to the present invention are polyolefin waxes e.g. polypropylene waxes, ester waxes e.g. fatty acid esters, polyolefin-polyether block copolymers, amide waxes e.g. fatty acid amides, polyglycols e.g. polyethylene glycol, fatty acids, fatty alcohols, natural waxes and solid phosphoric acid derivatives.

Preferred solid lubricants are fatty acid esters, polyolefin-polyether block copolymers and fatty acid amides. Preferred fatty acid esters are glycerine monostearate, glycerine monopalmitate and mixtures of glycerine monostearate and glycerine monopalmitate. Preferred fatty acid amides are selected from the group consisting of ethylenebisstearamide, stearamide, oleamide, myristamide and erucamide.

Hydrophilic Binder for Outermost Layer on same side of Support as Thermosensitive Element According to an embodiment of the present invention the outermost layer of the (photo)thermographic recording material may comprise a hydrophilic binder. Suitable hydrophilic binders for the outermost layer are, for example, gelatin, polyvinylalcohol, cellulose derivatives or other polysaccharides, hydroxyethylcellulose, hydroxypropylcellulose etc., with hardenable binders being preferred and polyvinylalcohol being particularly preferred.

Crosslinking Agents for Outermost Layer on same side of Support as Thermosensitive Element The outermost layer of the (photo)thermographic recording material, according to the present invention, may be crosslinked. Crosslinking can be achieved by using crosslinking agents such as described in WO 95/12495 for protective layers, e.g. tetra-alkoxysilanes, polyisocyanates, zirconates, titanates, melamine resins etc., with tetraalkoxysilanes such as tetramethylorthosilicate and tetraethylorthosilicate being preferred. When the outermost layer comes into contact with a thermal head during thermal processing, the outermost layer is preferably crosslinked.

Matting Agents for Outermost Layer on same side of Support as Thermosensitive Element The outermost layer of the (photo)thermographic recording material according to the present invention may comprise a matting agent. Suitable matting agents are described in WO 94/11198 and include e.g. talc particles and optionally protrude from the outermost layer.

Protective Layer

The outermost layer of the (photo)thermographic recording material on the same side of the support as the (photo-addressable) thermosensitive layer, according to the present invention, may be a protective layer applied to the (photo-addressable) thermosensitive element to avoid local deformation of the (photo-addressable) thermosensitive element and to improve resistance against abrasion.

The protective layer preferably comprises a binder, which may be hydrophobic (solvent soluble) of hydrophilic (water soluble). Among the hydrophobic binders polycarbonates as described in EP-A 614 769 are particularly preferred. However, hydrophilic binders are preferred for the protective layer, as coating can be performed from an aqueous composition and mixing of the hydrophilic protective layer with the immediate underlayer can be avoided by using a hydrophobic binder in the immediate underlayer.

A protective layer according to the present invention may comprise in addition at least one solid lubricant having a melting point below 150° C. and at least one liquid lubricant in a binder, wherein at least one of the lubricants is a phosphoric acid derivative, further dissolved lubricating material and/or particulate material, e.g. talc particles, optionally protruding from the outermost layer. Examples of suitable lubricating materials are surface active agents, liquid lubricants, solid lubricants which do not melt during thermal development of the recording material, solid lubricants which melt (thermomeltable) during thermal development of the recording material or mixtures thereof. The lubricant may be applied with or without a polymeric binder. The surface active agents may be any agents known in the art such as carboxylates, sulfonates, aliphatic amine salts, aliphatic quaternary ammonium salts, polyoxyethylene alkyl ethers and polyethylene glycol fatty acid esters. Examples of liquid lubricants include silicone oils, synthetic oils, saturated hydrocarbons and glycols. Examples of solid lubricants include various higher alcohols such as stearyl alcohol and fatty acids.

Such protective layers may also comprise particulate material, e.g. talc particles, optionally protruding from the protective outermost layer as described in WO 94/11198. Other additives can also be incorporated in the protective layer e.g. colloidal particles such as colloidal silica.

Coating

The coating of any layer of the (photo)thermographic recording materials of the present invention may proceed by any thin-film coating technique known in the art. In the coating of web type supports for photographic materials slide hopper coating is used advantageously, but other coating techniques such as dip coating and air knife coating may also be used. Details about such coating techniques can be found in "Modern Coating and Drying Technology" by Edward D. Cohen and Edgar B. Gutoff, published by VCH Publishers, Inc. 220 East 23rd Street, Suite 909 New York, N.Y. 10010.

Processing Configurations for Thermographic Recording Materials

Thermographic imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, or by direct thermal imaging with a thermal head.

As described in "Handbook of Imaging Materials", edited by Arthur S. Diamond—Diamond Research Corporation—Ventura, Calif., printed by Marcel Dekker, Inc. 270 Madison Avenue, New York, N.Y. 10016 (1991), p. 498–502 in thermal printing image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place. The operating temperature of common thermal printheads is in the range of 300° to 400° C. and the heating time per picture element (pixel) may be 50 ms or less, the pressure contact of the thermal printhead with the recording material being e.g. 100–500 g/cm$^2$ to ensure a good transfer of heat.

In order to avoid direct contact of the thermal printing heads with a recording material not provided with an outermost protective layer, the imagewise heating of the recording material with the thermal printing heads may proceed through a contacting but removable resin sheet or web wherefrom during the heating no transfer of recording material can take place.

In a particular embodiment of the method according to the present invention the direct thermal image-wise heating of the recording material proceeds by Joule effect heating in that selectively energized electrical resistors of a thermal head array are used in contact or close proximity with the recording layer. Suitable thermal printing heads are e.g. a Fujitsu Thermal Head (FTP-040 MCS001), a TDK Thermal Head F415 HH7-1089 and a Rohm Thermal Head KE 2008-F3.

The image signals for modulating the current in the micro-resistors of a thermal printhead are obtained directly e.g. from opto-electronic scanning devices or from an intermediary storage means, e.g. magnetic disc or tape or optical disc storage medium, optionally linked to a digital image work station wherein the image information can be processed to satisfy particular needs.

Activation of the heating elements can be power-modulated or pulse-length modulated at constant power.

When used in thermographic recording operating with thermal printheads the recording materials will not be suited for reproducing images with fairly large number of grey levels as is required for continuous tone reproduction.

According to EP-A 622 217 relating to a method for making an image using a direct thermal imaging element, improvements in continuous tone reproduction are obtained by heating the thermal recording element by means of a thermal head having a plurality of heating elements, characterized in that the activation of the heating elements is executed line by line with a duty cycle Δ representing the ratio of activation time to total line time in such a way that the following equation is satisfied:

$$P \leq P_{max} = 3.3\ \mathrm{W/mm^2} + (9.5\ \mathrm{W/mm^2} \times \Delta)$$

wherein $P_{max}$ is the maximal value over all the heating elements of the time averaged power density P (expressed in W/mm$^2$) dissipated by a heating element during a line time.

Recording Process for Photothermographic Recording Materials

Photothermographic recording materials, according to the present invention, may be exposed with radiation of wavelength between an X-ray wavelength and a 5 microns wavelength with the image either being obtained by pixel-wise exposure with a finely focussed light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light.

For the thermal development of image-wise exposed photothermo-graphic recording materials, according to the present invention, any sort of heat source can be used that enables the recording materials to be uniformly heated to the development temperature in a time acceptable for the application concerned e.g. contact heating with for example a heated roller or a thermal head, radiative heating, microwave heating etc.

Applications

The thermographic and photothermographic recording materials of the present invention can be used for both the production of transparencies and reflection type prints. This means that the support will be transparent or opaque, e.g. having a white light reflecting aspect. For example, a paper base substrate is present which may contain white reflecting pigments, optionally also applied in an interlayer between the recording material and the paper base substrate. Should a transparent base be used, the base may be colourless or coloured, e.g. has a blue colour.

In the hard copy field recording materials on a white opaque base are used, whereas in the medical diagnostic field black-imaged transparencies are widely used in inspection techniques operating with a light box.

Application of the present invention is envisaged in the fields of both graphics images requiring high contrast images with a very steep print density applied dot energy dependence and continuous tone images requiring a weaker print density applied dot energy dependence, such as required in the medical diagnostic field Direct thermal imaging can be used for both the production of transparencies and reflection type prints.

Determination of Static and Dynamic Frictional Coefficients

The static and dynamic frictional coefficients between two materials was determined by fastening a 35×274 mm strip with the first material uppermost, placing a 35×274 mm strip with the second material in contact with the uppermost layer of the first strip, attaching the end of the second strip to a calibrated strain gauge either directly as in the case of dynamic measurements or via a spring (spring constant 0.2N/m) as in the case of static measurements, placing a 117 g hard rubber roller on the second strip, setting the strain gauge in motion at a constant speed of 15 cm/minute in a horizontal direction over a displacement of 13 cm and recording the voltage output from the strain gauge. The voltages are converted into pulling forces using a calibration plot obtained using standard weights and the frictional coefficient $\mu$ calculated using the expression:

$$\mu = \frac{\text{pulling force}, F_G}{\text{load}, N}$$

In the case of the determination of a dynamic frictional coefficient, $\mu_{dynamicd}$, $F_G$ does not fluctuate much and an average value for $F_G$ is taken to calculate the $\mu_{dynamic}$ value given in the invention and comparative examples. However, in the case of static frictional coefficient measurements $F_G$ steadily increases to a maximum value as the spring takes up the strain until movement occurs, whereupon $F_G$ decreases only to rise again to this maximum value when the movement stops and so on. It is this maximum value of $F_G$ which is used in the calculation of the $\mu_{static}$ given in the invention and comparative examples.

The values given in the invention and comparative examples are the average values of four measurements with different strips carried out at 21° C. and 50% relative humidity, the strips being conditioned in this atmosphere for at least 4 hours before the measurements are carried out.

The following ingredients were used in the invention and comparative examples of the present invention:

antistatic layer ingredients

KELZAN™ S: a xanthan gum from MERCK & CO., Kelco Division, USA, which according to Technical Bulletin DB-19 is a polysaccharide containing mannose, glucose and glucuronic repeating units as a mixed potassium, sodium and calcium salt;

PT-dispersion: a dispersion of poly(3,4-ethylenedioxy-thiophene)/polystyrene sulphonic acid produced by the polymerization of 3,4-ethylenedioxy-thiophene in the presence of polystyrene sulphonic acid and ferric sulphate as described in U.S. Pat. No. 5,354,613;

HOSTAPAL™ B: nonyl-phenyl (oxyethylene)$_5$-O-$SO_3$Na from HOECHST;

ULTRAVON™ W: an aryl sulfonate from CIBA-GEIGY;

PERAPRET™ PE40: a 40% aqueous dispersion of polyethylene wax from BASF;

KIESELSOL 100F: a 36% aqueous dispersion of colloidal silica from BAYER;

LATEX01: a 12% by weight dispersion of polymethyl methacrylate with an average particle size of 88.8 nm prepared as described in U.S. Pat. No. 5,354,613;

LATEX02: a 20% by weight dispersion of polymethyl methacrylate with an average particle size of 88.8 nm prepared as described in U.S. Pat. 5,354,613;

PMMA: polymethylmethacrylate, Acryloid™ K12ON from ROHM & HAAS.

thermosensitive element as organic silver salt: silver behenate;

as binder: polyvinyl butyral (BUTVAR™ B79);

as reducing agent: ethyl 3,4-dihydroxybenzoate;

as toning agents: benzo[e][1,3]oxazine-2,4-dione and 7-(ethylcarbonato)benzo[e][1,3]oxazine-2,4-dione;

as levelling agent: silicone oil (Baysilonel™ from Bayer AG);* as stabilizers:
tetrachlorophthalic anhydride;
adipic acid;
benzotriazole;

photo-addressable thermosensitive element i) silver behenate/silver halide emulsion layer:

GEL: phthaloylgelatin, type 16875 from ROUSSELOT;

Butvar™ B76: polyvinylbutyral from MONSANTO;

LOWINOX™ 22IB46: 2-propyl-bis(2-hydroxy-3,5-dimethylphenyl)methane from CHEM. WERKE LOWI;

PHP: pyridinium hydrobromide perbromide;

CBBA: 2-(4-chlorobenzoyl)benzoic acid;

TMPS: tribromomethyl benzenesulfinate;

MBI: 2-mercaptobenzimidazole;

SENSI:

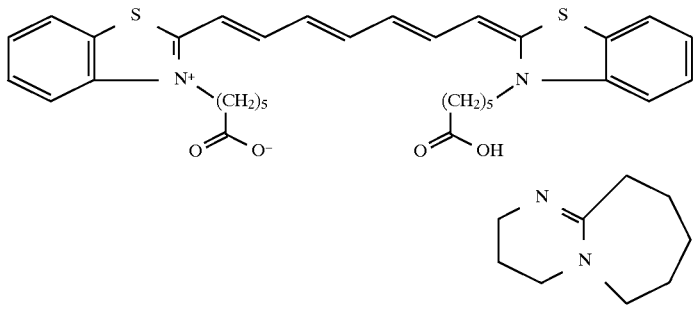

ii) protective layer:

CAB: cellulose acetate butyrate, CAB-171-15S from EASTMAN;

PMMA: polymethylmethacrylate, Acryloid™ K12ON from ROHM & HAAS.

The following examples illustrate the present invention without however limiting it thereto. All percentages, parts and ratios are by weight unless otherwise mentioned.

INVENTION EXAMPLES 1 to 4 and COMPARATIVE EXAMPLES 1 and 2

A 0.34 mm transparent blue polyethylene terephthalate sheet was coated on both sides to a thickness of 0.1 mm with a subbing layer composition which after drying and longitudinal and transverse stretching produced a 175 μm thick support coated on both sides with the following subbing-layer composition expressed as the coating weights of the ingredients present:

# terpolymer latex of vinylidene chloride/methyl acrylate/itaconic acid (88/10/2): 0.16 g/m$^2$ # colloidal silica (Kieselsol™ 100F from BAYER): 0. 04 g/m$^2$ # alkyl sulfonate surfactant (Mersolat™ H from BAYER): 0.6 mg/m$^2$ # aryl sulfonate surfactant (Ultravon™ W from CIBA-GEIGY): 4 mg/m$^2$

Backside Layer

The 175 μm thick longitudinally stretched polyethylene terephthalate support was then coated on one side with different backside layer compositions which after drying at 130° C. produced the following layer compositions, expressed as the coating weights of the ingredients present:

# polysaccharide (Kelzan™ S from MERCK & CO, KELCO DIV.): 10 mg/m$^2$ # polyethylenedioxythiophene: 5 mg/m$^2$ # polystyrene sulfonic acid: 10 mg/m$^2$ # aryl sulfonate surfactant (Ultravon™ W from CIBA-GEIGY): 21 mg/m$^2$ # polyethylene wax (Perapret™ PE40 from BASF): 10 mg/m$^2$ # polymethylmethacrylate latex (LATEX 02): 200 mg/m$^2$ together with the polymer beads and colloidal silica (Kieselsol™ 100F from BAYER) as specified with the results concerning the transport properties of the complete materials in table 1.

Thermosensitive Element

The subbed polyethylene terephthalate support having a thickness of 175 μm was doctor blade-coated on the side not coated with the backside layers with a coating composition containing 2-butanone as solvent so as to obtain thereon, after drying for 1 hour at 50° C., a thermosensitive element with the following composition:

# silver behenate: 4.90 g/m$^2$ # polyvinyl butyral (Butvar™ B79 from MONSANTO): 19.62 g/m$^2$ # silicone oil (Baysilon™ MA from BAYER): 0.045 g/m$^2$ # benzo[e][1,3]oxazine-2,4-dione: 0.268 g/m$^2$

7-(ethylcarbonato)benzo[e][1,3]oxazine-2,4-dione: 0.138 g/m$^2$ ethyl 3,4-dihydroxybenzoate: 1.003 g/m$^2$ # adipic acid: 0.352 g/m$^2$ # benzotriazole: 0.130 g/m$^2$

Protective Layer

The thermosensitive element was then coated with an aqueous composition. The pH of the coating composition was adjusted to a pH of 4 by adding 1N nitric acid. Those lubricants which were insoluble in water, were dispersed in a ball mill with, if necessary, the aid of a dispersion agent. The composition was coated to a wet layer thickness of 85 μm and then dried at 40° C. for 15 minutes and hardened at 45° C. and a relative humidity of 70% for 7 days to produce a layer with the following composition expressed as the coating weight of the ingredients present:

# polyvinylalcohol (Mowiviol™ WX 48 20, Wacker Chemie): 4.9 g/m$^2$ # dispersion agent (Ultravon™ W from Ciba Geigy)*: 0.075 g/m$^2$ # colloidal silica (Levasil™ VP AC 4055 from Bayer AG, a 15% aqueous dispersion of colloidal silica): 1.05 g/m$^2$ # mono[isotridecyl polyglycolether (3 EO)] phosphate (Servoxyl™ VPDZ 3/100 from Servo Delden): 0.075 g/m$^2$ # mixture of monolauryl and dilauryl phosphates (Servoxyl VPAZ 100 from Servo Delden): 0.075 g/m$^2$ # talc (Steamic™ OOS from Talc de Lusenac): 0.045 g/m$^2$ # porous silica (Syloid™ 72 from Grace): 0.09 g/m$^2$ # glycerine monotallow acid ester (Rilanit# GMS from Henkel): 0.15 g/m$^2$ # tetramethylorthosilicate (hydrolyzed in the presence of methanesulfonic acid): 0.87 g/m$^2$ converted into acid form by passing through an ion exchange column.

Thermographic Printing

The thermographic recording materials of invention examples 1 to 4 were printed using a DRYSTAR™ 2000 printer (from AGFA-GEVAERT) at an average printing power of 63 mW/dot. The printed images obtained all exhibited maximum densities,measured through a visual filter with a Macbeth™ TR924 densitometer, between 3.00 and 3.40 and minimum densities below 0.10.

The colour neutrality the optical density (D) of these printed images was evaluated by measuring the optical densities through blue, green and red filters using a MacBeth™ TR924 densitometer. The lowest, next highest and highest optical densities were assigned to $D_1$, $D_2$ and $D_3$ respectively and were used to obtain a numerical colour value (NCV) by substituting the corresponding values in the following equation:

$$NCV = \frac{D_1 \times D_2}{(D_3)^2}$$

Maximal colour neutrality corresponds to a NCV value of 1. NCV-values well above 0.90 were observed throughout the optical density range with all the printed images, indicating a neutral grey tone.

The uniformity of the printed images was excellent at all optical density levels between the maximum and minimum densities i.e. no pinholes were present.

Surface Roughness Measurements

The surface roughness of the protective and outermost backside layers were evaluated with a PERTHOMETER™ apparatus from PERTHEN AG and the $R_z$ values determined according to DIN 4768/1, where $R_z$ is the average of the single peak-to-valley heights of five adjoining sampling lengths $1_e$. The $R_z$-values found for the protective and outermost backside layers of the thermographic recording materials of invention example 2 and comparative example 2 are given in table 2

Frictional Coefficient between Backside and Protective Layers

The frictional coefficient between the outermost backside layer of thermographic recording materials of invention examples 1 to 4 and comparative examples 1 and 2 and the protective layers thereof as described above with the outermost layer on the same side of the support as the thermosensitive element of the first strip mounted uppermost on the platform and the outermost backside layer of the second strip in contact therewith. The results for the thermographic materials of invention examples 1 to 4 and comparative examples 1 and 2 are given in table 2.

Evaluation of the Transport Performance of the Materials

After coating the support with a thermosensitive element and a protective layer thereon on the non-backside layer-coated side, the protective layer was hardened at 45° C. and 70% relative humidity for 7 days For each of the materials of comparative examples 1 and 2 and invention examples 1 to 4 two packs of 50 sheets each were produced and one of them was subjected to 35° C. and 80% relative humidity for an additional 7 days and the other to 45° C. and 70% relative humidity for an additional 7 days.

After this thermal conditioning, the transport performance of each sheets in each pack was qualitatively assessed by tilting the pack at 45° and observing how easily the sheets moved relative to one another and awarding numerical scores according to the following criteria:

0=sheets slide easily and rapidly apart

1=sheets slide slowly but easily apart

2=3 to 4 sheets stick together

3=packs of 20 sheets stick together

4=whole pack of 50 sticks together in a single block

This a simulation of sheet feeding processes. Sheets with a numerical score of 4, in our experience, give rise to a high incidence of double-sheet feeding in printers. The results obtained are summarized in table 2.

TABLE 2

| Comparative example number | Coating wt. of Kieselsol F [mg/m²] | Coating weight of MAT01* beads [mg/m²] | $R_Z$ of protective layer [μm] | $R_Z$ of outer backside layer [μm] | Frictional coefficient between backside & protective layers $\mu_{static}$ | Transport performance after 7d at 35° C. & 80% RH | Transport performance after 7d at 45° C. & 70% RH |
|---|---|---|---|---|---|---|---|
| 1 | 20 | – | – | – | 0.25 | 3–4 | 4 |
| 2 | 70 | – | 1.44 | 0.35 | 0.28 | 4 | 4 |
| Invention example number | | | | | | | |
| 1 | 20 | 6 | – | – | 0.23 | 1 | 2 |
| 2 | 20 | 30 | 1.44 | 3.65 | 0.22 | 0 | 1 |
| 3 | 70 | 6 | – | – | 0.23 | 2 | 3 |
| 4 | 70 | 30 | – | – | 0.24 | 1 | 1 |

*methylmethacrylate(98% by weight)-stearylmethacrylate(2% by weight)-copolymeric latex produced as described in U.S. Pat. No. 4,861,812

The thermographic recording materials of invention examples 1 to 4 all exhibited a $\mu_{static}$ value ≦0.24 and at least a satisfactory transport performance, whereas the thermographic recording materials of comparative examples 1 and 2 exhibited $\mu_{static}$ values>0.24 and a very poor transport performance.

INVENTION EXAMPLES 5 and 6

Support

A polyethyleneterephthalate (PET) foil was first coated on both sides with a subbing layer consisting of a terpolymer latex of vinylidene chloride-methyl acrylate-itaconic acid (88/10/2) in admixture with colloidal silica (surface area 100 $m^2/g$). After stretching the foil in the transverse direction the foil had a thickness of 175 $\mu$m with coverages of the terpolymer and of the silica in the subbing layers of 170 $mg/m^2$ and 40 $mg/m^2$ respectively on each side of the PET-foil.

Antistatic Backside Outermost Layer

One side of the thus subbed PET-foil was then coated with an antistatic composition consisting obtained by dissolving 0.30 g of KELZANT™ S in a stirred mixture of 22.4 mL of N-methylpyrrolidone, 0.84 g of ULTRAVON™ W. 1 g of PERAPRET™ PE40 and 2.22 g of KIESELSOL 100F in 74.3 mL of deionized water and then adding with stirring: 0.2 mL of $NH_40H$, 0.6 g of dried PT-dispersion, 66.7 mL of LATEX01, small quantities of different polymethylmethacrylate beads of weight averaged diameters as specified in table 3 in sufficient quantity to give the coating weights specified in table 3 and 30 mL of 2-propanol to produce a layer after drying at 120° C. consisting of:

TABLE 3

| | |
|---|---|
| KELZAN ™ S: | 7.5 $mg/m^2$ |
| Dried PT-dispersion: | 15 $mg/m^2$ |
| ULTRAVON ® W: | 21 $mg/m^2$ |
| polyethylene wax (from PERAPRET ™ PE40): | 10 $mg/m^2$ |
| colloidal silica (from KIESELSOL ™ 100F): | 20 $mg/m^2$ |
| polymethylmethacrylate (from LATEX01): | 200 $mg/m^2$ |

| Backside layer number | MAT01 beads# [$mg/m^2$] | 3 $\mu$m PMMA beads* [$mg/m^2$] |
|---|---|---|
| B01 | 6 | — |
| B02 | — | 0.3 |

#methylmethacrylate(98% by weight)-stearylmethacrylate(2% by weight)-copolymeric latex produced as described in U.S. Pat. No. 4,861,812
*polymethylmethacrylate latex produced as described in U.S. Pat. No. 4,861,812

Silver Halide Emulsion

An silver halide emulsion consisting of 3.11% by weight of silver halide particles consisting of 97 mol% silver bromide and 3 mol% silver iodide with an weight average particle size of 50 nm, 0.47% by weight of GEL as dispersing agent in deionized water was prepared using conventional silver halide preparation techniques such as described, for example, in T. H. James, "The Theory of the Photographic Process", Fourth Edition, Macmillan Publishing Co. Inc., New York (1977), Chapter 3, pages 88–104.

Silver Behenate/Silver Halide Emulsion

The silver behenate/silver halide emulsion was prepared by adding a solution of 6.8 kg of behenic acid in 67 L of 2-propanol at 65° C. to a 400 L vessel heated to maintain the temperature of the contents at 65° C., converting 96% of the behenic acid to sodium behenate by adding with stirring 76.8 L of 0.25M sodium hydroxide in deionized water, then adding with stirring 10.5 kg of the above-described silver halide emulsion at 40° C. and finally adding with stirring 48 L of a 0.4M solution of silver nitrate in deionized water. Upon completion of the addition of silver nitrate the contents of the vessel were allowed to cool and the precipitate filtered off, washed, slurried with water, filtered again and finally dried at 40° C. for 72 hours.

8.97 g of the dried powder containing 9 mol% silver halide and 2.4 mol% behenic acid with respect to silver behenate were then dispersed in a solution of 9.15 g of Butvar™ B76 in 38.39 g of 2-butanone using conventional dispersion techniques yield a 32% by weight dispersion. A solution of 3.31 g of Butvar™ B76 in 28.33 g of 2-butanone was then added yielding a 24.3% by weight dispersion.

Coating and Drying of Silver Behenate/Silver Halide Emulsion Layer

An emulsion layer coating composition for the photothermographic recording materials of invention examples 5 and 6 was prepared by adding the following solutions or liquids to the above-mentioned silver behenate/silver halide emulsion in the following sequence with stirring: 0.8 g of a 11.5% solution of PHP in methanol followed by a 2 hours stirring, 1 g of 2-butanone, 0.2 g of a 11% solution of calcium bromide in methanol and 1 g of 2-butanone followed by 30 minutes stirring, 0.6 g of CBBA, 1.33 g of a 0.2% solution of SENSI in 99:1 methanol:triethylamine and 0.04 g of MBI followed by 15 minutes stirring, 2.78 g of LOWINOX™ 22IB46 and finally 0.5 g of TMPS followed by 15 minutes stirring.

The PET-foil subbed and coated with an antistatic layer as described above was then doctor blade-coated at a blade setting of 150 $\mu$m on the side of the foil not coated with an antistatic layer with the coating composition to a wet layer thickness of 0.104 $\mu$m, which after drying for 5 minutes at 80° C. on an aluminum plate in a drying cupboard produced a layer with the following composition:

| | |
|---|---|
| Butvar ® B76 | 12.49 $g/m^2$ |
| GEL | 0.045 $g/m^2$ |
| $AgBr_{0.97}I_{0.03}$ | 0.301 $g/m^2$ |
| Behenic acid | 0.145 $g/m^2$ |
| silver behenate | 7.929 $g/m^2$ |
| PHP | 0.092 $g/m^2$ |
| calcium bromide | 0.022/$m^2$ |
| LOWINOX ™ 22IB46 | 2.78/$m^2$ |
| CBBA | 0.600 $g/m^2$ |
| SENSI | 0.00266 $g/m^2$ |
| MBI | 0.04 $g/m^2$ |
| TMPS | 0.500 $g/m^2$ |

Protective Layer

A protective layer coating composition for the photothermographic recording materials of invention examples 5 and 6 were prepared by dissolving 4.08 g of CAB and 0.16 g of PMMA in 56.06 g of 2-butanone and 5.2 g methanol and adding ingredients with stirring in the following sequence: 0.5 g of phthalazine, 0.2 g of 4-methylphthalic acid, 0.1 g of tetrachlorophthalic acid, 0.2 of tetrachlorophthalic acid anhydride and optionally 50 mg of TEGOGLIDE™ 410 (from GOLDSCHMIDT).

The emulsion layers were then doctor blade-coated at a blade setting of 100 $\mu$m with the appropriate protective layer compositions to a wet layer thickness of 70 $\mu$m, which after drying for 8 minutes at 80° C. on an aluminum plate in a drying cupboard produced a layer with the compositions P01 and P02 in table 4:

TABLE 4

| Protective layer | Binder | | TEGOGLIDE ™ 410 | Phthal-azine | 4-methyl phthalic acid | tetra-chloro-phthalic acid | tetrachloro-phthalic acid anhydride |
|---|---|---|---|---|---|---|---|
| number | type | [g/m²] | [mg/m²] | [g/m²] | [g/m²] | [g/m²] | [g/m²] |
| P01 | CAB | 4.08 | 50 | 0.5 | 0.2 | 0.1 | 0.2 |
| | PMMA | 4.08 | | | | | |
| P02 | CAB | 0.16 | — | 0.5 | 0.2 | 0.1 | 0.2 |
| | PMMA | 0.16 | | | | | |

The backside and protective layers of the photothermographic materials of invention examples 5 and 6 are given below in table 6.

Image-Wise Exposure and Thermal Processing

The photothermographic recording materials of invention examples 5 and 6 were exposed to a 849 nm single mode diode laser beam from SPECTRA DIODE LABS with a nominal power of 100 mW of which 50 mW actually reaches the recording material focussed to give a spot diameter ($1/e^2$) of 28 $\mu$m, scanned at speed of 50 m/s with a pitch of 14 $\mu$m through a wedge filter with optical density varying between 0 and 3.0 in optical density steps of 0.15.

Thermal processing was carried out for 10 s on a drum heated to a temperature of 119° C. and the $D_{max}$-and $D_{min}$-values of the resulting wedge images were evaluated with a MACBETH™ TD904 densitometer with an ortho filter to produce a sensitometric curve for the photothermographic material with the results given in table 5.

TABLE 5

| Invention example | image characteristics | |
|---|---|---|
| number | $D_{max}$ | $D_{min}$ |
| 5 | 3.65 | 0.21 |
| 6 | 3.65 | 0.21 |
| 7 | 3.65 | 0.21 |

Evaluation of Surface Roughness, Frictional and Transport Properties

The surface roughness of the protective and outermost backside layers were evaluated with a PERTHOMETER™ apparatus from PERTHEN AG and the $R_z$ values determined according to DIN 4768/1, where $R_z$ is the average of the single peak-to-valley heights of five adjoining sampling lengths $l_e$. The $R_z$-values found for the protective and outermost backside layers of the photothermographic recording materials of invention examples 5 and 6 are given in table 6.

The frictional coefficients between the protective and outermost backside layers of the photothermographic recording materials of invention examples 5 and 6 were evaluated as described above except that the first strip was mounted on the platform with the outermost backside layer uppermost and the outermost layer on the same side of the support as the photo-addressable thermosensitive element of the second strip in contact therewith. The results for the photothermographic materials of invention examples 5 to 7 are given in table 6.

The transport performance was evaluated qualitatively as described for the thermographic recording materials of invention examples 1 to 4 and comparative examples 1 and 2, the results also being given in table 6.

TABLE 6

| Invention | Protective layer | | Outermost backside layer | | Frictional coefficient between protective and outer backside layers | | Transport |
|---|---|---|---|---|---|---|---|
| example | number | $R_Z$ | number | $R_Z$ | | | performance |
| number | | [$\mu$m] | | [$\mu$m] | $\mu_{static}$ | $\mu_{dynamic}$ | |
| 5 | P01 | 0.22 | B02 | 0.32 | 0.14 | 0.13 | 1–2 |
| 6 | P01 | 0.23 | B01 | 2.07 | 0.10 | 0.09 | 0 |

The photothermographic recording materials of invention examples 5 and 6 exhibited a $\mu_{static}$ value $\leqq 0.24$ (invention example 5) or both a $\mu_{static}$ value $\leqq 0.24$ and an $R_z$ for the backside layer >1.75 $\mu$m (invention example 6) together with $R_z$ for the protective layer <1.75 $\mu$m. A satisfactory transport performance was also observed for the two materials.

INVENTION EXAMPLES 7 and 8 and COMPARATIVE EXAMPLES 3 to 7

Simulation photothermographic materials were also produced to evaluate transport performance in different configurations. A B03 non-antistatic-outermost backside layer with the composition given in table 7 was coated on an antistatic layer as described for the photothermographic recording materials of invention examples 5 and 6, but without the added PMMA-beads.

TABLE 7

| Backside layer | Backside layer binder | | 1 $\mu$m PMMA beads* | TEGOGLIDE ™ 410 |
|---|---|---|---|---|
| number | type | [g/m²] | [mg/m²] | [mg/m²] |
| B03 | PMMA | 0.5 | 1 | 1.5 |

*methylmethacrylate(90% by weight)-acrylic acid(5% by weight)-vinylbenzylchloride(5% by weight)-terpolymeric latex produced as described in U.S. Pat. No. 4.861,812

The opposite side of the support to the non-antistatic backside layer was then coated with the layer compositions given in table 8 to simulate protective layers.

TABLE 8

| Protective layer | Binder | | TEGOGLIDE ™ 410 | Phthalazine | 4-methyl phthalic acid | tetrachloro-phthalic acid | tetrachloro-phthalic acid anhydride |
|---|---|---|---|---|---|---|---|
| number | type | [g/m²] | [mg/m²] | [g/m²] | [g/m²] | [g/m²] | [g/m²] |
| P03 | CDA | 3.5 | 52 | — | — | — | — |
| P04 | PMMA | 3.0 | — | — | — | — | |
| P05 | CAB | 3.0 | 90 | — | — | — | |

The backside and simulated protective layers of the materials of invention examples 7 and 8 and comparative examples 3 to 7 are given below in table 9. The frictional and transport properties of these materials were evaluated as described for invention examples 5 and 6 and the results are summarized in table 9.

TABLE 9

| Invention | Protective layer | | Outermost backside layer | | Frictional coefficient between protective and outer backside layers | | Transport |
|---|---|---|---|---|---|---|---|
| example number | number | $R_Z$ [μm] | number | $R_Z$ [μm] | $\mu_{static}$ | $\mu_{dynamic}$ | performance |
| 7 | P05 | 0.22 | B02 | 0.30 | 0.15 | 0.16 | 0 |
| 8 | P03 | 0.22 | B01 | 0.53 | 0.15 | 0.13 | 0 |
| Comparative example number | | | | | | | |
| 3 | P03 | 0.21 | B03 | 0.23 | 3.6 | 0.65 | 3 |
| 4 | P04 | 0.38 | B03 | 0.29 | 3.1 | 0.44 | 4 |
| 5 | P04 | 0.42 | B02 | 0.37 | 0.44 | 0.41 | 4 |
| 6 | P05 | 0.44 | B03 | 0.24 | 0.38 | 0.31 | 4 |
| 7 | P02 | 0.41 | B02 | 0.39 | 0.47 | 0.45 | 4 |

The materials of invention examples 7 and 8 $\mu_{static}$ value ≦0.24 and had an $R_z$ for the backside layer <1.75 μm. Both materials also exhibited satisfactory transport performance.

The materials of comparative examples 3 to 7, on the other hand, exhibited neither $\mu_{static}$ ≦0.24 nor an $R_z$ for the backside layer >1.75 μm and exhibited a very poor transport performance.

Having described in detail preferred embodiments of the current invention, it will now be apparent to those skilled in the art that numerous modifications can be made therein without departing from the scope of the invention as defined in the following claims.

We claim:

1. A thermographic recording material comprising a thermosensitive element on one side of a water resistant support and an outermost backside layer on the other side of said water resistant support, said thermosensitive element comprising a substantially light-insensitive organic silver salt, an organic reducing agent for said substantially light-insensitive organic silver salt in thermal working relationship therewith and a binder and said outermost backside layer comprising polymeric beads, characterized in that an outermost layer on said side of said water resistant support with said thermosensitive element does not contain a fluorine-containing polymeric surfactant and the static frictional coefficient between said outermost layer on said side of said water resistant support with said thermosensitive element and said outermost backside layer is ≦0.24 and/or said outermost backside layer of said thermographic recording material has an $R_z$ determined according to DIN 4768/1 of >1.75 μm.

2. Thermographic recording material according to claim 1, wherein said outermost backside layer of said thermographic recording material further comprises an antistatic species.

3. Thermographic recording material according to claim 1, wherein said outermost backside layer of said thermographic recording material further comprises colloidal silica.

4. Thermographic recording material according to claim 1, wherein said outermost layer on said side of said water resistant support with said thermosensitive element has an $R_z$ determined according to DIN 4768/1 of <1.75 μm.

5. A thermographic recording process comprising the steps of: (i) providing a thermographic recording material comprising a thermosensitive element on one side of a water resistant support and an outermost backside layer on the other side of said water resistant support, said thermosensitive element comprising a substantially light-insensitive organic silver salt, an organic reducing agent for said substantially light-insensitive organic silver salt in thermal working relationship therewith and a binder and said outermost backside layer comprising polymeric beads; (ii) bringing said side of said water resistant support with said thermosensitive element into contact with a thermal head; (iii) image-wise heating said thermographic material by pixel-wise heating with said thermal head; and (iv) removing said thermographic recording material from said thermal head, wherein an outermost layer on said side of said water resistant support with said thermosensitive element does not contain a fluorine-containing polymeric surfactant and the static frictional coefficient between said outermost layer on said side of said water resistant support with said thermosensitive element and said outermost backside layer is ≦0.24 and/or said outermost backside layer of said thermographic recording material has an $R_z$ determined according to DIN 4768/1 of >1.75 μm.

6. Thermographic recording process according to claim 5, wherein said outermost backside layer of said thermographic recording material further comprises an antistatic species.

7. Thermographic recording process according to claim 5, wherein said outermost backside layer of said thermographic recording material further comprises colloidal silica.

8. Thermographic recording process according to claim 5, wherein said outermost layer on said side of said water resistant support with said thermosensitive element has an $R_z$ determined according to DIN 4768/1 of <1.75 μm.

* * * * *

UNITED STATES PATENT AND TRADEMARK OFFICE

CERTIFICATE OF CORRECTION

PATENT NO. : 5,883,042
DATED : March 16, 1999
INVENTOR(S) : Defieuw et al.

It is certified that error appears in the above-identified patent and that said Letters Patent is hereby corrected as shown below:

Column 12, line 59: "ÖA" should read -- Öl A --;

Column 17, line 44: "$\mu_{dynamicd}$," should read -- $\mu_{dynamic}$, --;

Column 20, line 62: "converted" should read -- * converted --;

Column 23, line 12: "KELZANT™" should read -- KELZAN™ --;

Column 23, line 16: "$NH_40H$," should read -- $NH_4OH$, --;

Column 23, line 23: "_TABLE 3_" should be deleted and moved to line 30, above "Backside layer number";

Column 23, line 27: "ULTRAVON®" should read -- ULTRAVON™ --;

Column 24, line 35: "Butvar®" should read -- Butvar™ --.

Signed and Sealed this

Eighth Day of May, 2001

*Attest:*

Nicholas P. Godici

NICHOLAS P. GODICI

*Attesting Officer*

*Acting Director of the United States Patent and Trademark Office*